United States Patent [19]

Hirano et al.

[11] Patent Number: 4,977,640

[45] Date of Patent: Dec. 18, 1990

[54] FLOOR NOZZLE FOR VACUUM CLEANER

[75] Inventors: Akihiro Hirano, Yokaichi; Seizo Hayashi, Omihachiman, both of Japan

[73] Assignee: Matsushita Electric Industrial Co., Ltd., Osaka, Japan

[21] Appl. No.: 381,280

[22] Filed: Jul. 18, 1989

[30] Foreign Application Priority Data

Jul. 22, 1988 [JP] Japan ..... 63-184346

[51] Int. Cl.[5] ..... A47L 5/30

[52] U.S. Cl. ..... 15/339; 15/340.3; 15/389; 15/390; 15/340.2

[58] Field of Search ..... 15/388, 389, 390, 339, 15/340.3, 340.4, 340.2

[56] References Cited

U.S. PATENT DOCUMENTS

| | | | |
|---|---|---|---|
| 2,871,503 | 2/1959 | Senne | 15/327 |
| 3,218,876 | 11/1965 | Berger | 74/202 |
| 3,220,043 | 11/1965 | Lampe | 15/340.2 |
| 3,624,861 | 12/1971 | Freiheit | 15/340.2 X |
| 3,938,216 | 2/1976 | Schmitz et al. | 15/340.2 |
| 4,139,922 | 2/1979 | Fitch | 15/372 X |
| 4,624,027 | 11/1986 | Martin | 15/340.2 |
| 4,654,927 | 4/1987 | Novinger | 15/340.4 X |

FOREIGN PATENT DOCUMENTS

| | | |
|---|---|---|
| 51-57368 | 11/1977 | Japan . |
| 1212837 | 11/1970 | United Kingdom . |

*Primary Examiner*—Chris K. Moore

*Attorney, Agent, or Firm*—Wenderoth, Lind & Ponack

[57] ABSTRACT

A floor nozzle for a vacuum cleaner which includes a housing, and an agitator, a driving motor for the agitator, and a switch for changing over rotating directions of the motor which are accommodated in the housing, and a coupling pipe connected to the housing so as to be displaceable at least back and fourth, and communicated with a suction passage to a vacuum cleaner main body, and an associating device for transmitting the back and forth displacement of the coupling pipe to the switch. The associating device is adapted to be held at two stabilized positions with respect to a boundary dead point and provided with a movable member arranged to be displaced through quick action, to one of the stabilized positions after passing through the dead point, with the movable member being associated with the switch.

11 Claims, 5 Drawing Sheets

FLOOR NOZZLE FOR VACUUM CLEANER

BACKGROUND OF THE INVENTION

The present invention generally relates to an electric vacuum cleaner and more particularly, to a floor nozzle for use in a vacuum cleaner, provided therein with an agitator driven for rotation by a motor.

Conventionally, in a floor nozzle of this kind, rotating direction of the agitator is set to be only in one direction, and generally, when the operability of the floor nozzle is taken into account, such rotating direction is determined to be in a forward direction so as not to provide a resistance during advancing of the floor nozzle, while in the case where a dust rake-up characteristic of the agitator is taken into consideration, the agitator is set to be rotated in the opposite direction.

When the rotation of the agitator is selected to be in the former forward direction, it will be readily understood that a reaction force for advancing the nozzle is produced between the agitator and the floor, and thus, labor required for the advancing of the floor nozzle may be reduced by that extent.

Meanwhile, the selection of rotation of the agitator in the latter opposite direction is intended to improve the dust rake-up characteristic by the agitator even at the sacrifice of the operability during advancing of the floor nozzle. More specifically, in the above case, relative contact resistance between the floor, e.g. a carpet and the agitator is desirably increased, whereby dust or dirt adhering to filaments, etc. of the carpet may be favorably scraped off.

Incidentally, it has been known in the actual operation of the floor nozzle, that the movement of the floor nozzle is not limited to the advancing, but reciprocating movements repeating advancing and retreatment thereof are also included.

Therefore, the rotation of the agitator only in one direction as referred to above undesirably gives rise to a result contrary to the intended object during retreatment of the floor nozzle.

In order to overcome the problem as referred to above, there has been conventionally proposed an arrangement adapted to change-over the rotational direction of the motor according to advancement or retreatment of the floor nozzle. More specifically, in such arrangement, a play in the forward and backward directions is provided at junction between an extension pipe coupled with the suction side of the vacuum cleaner through a hose and the floor nozzle and movement of the junction within a range of said play according to the forward and backward operations of the floor nozzle is associated with change-over of a switch intended to alter the rotating direction of a motor.

By the known arrangement as described above, the agitator is to be rotated in the direction which will accomplish the intended object according to the advancing and retreating of the floor nozzle. However, in the above arrangement provided with the change-over switch, since an intermediate point for the change-over, i.e. a long OFF time is present, there are cases where the change-over of rotational directions of the motor is not favorably effected, while due to the fact that the change-over itself is to be effected slowly, an electric arc tends to be produced at contact portions, thus resulting in troubles such as adhesion by fusion, etc.

SUMMARY OF THE INVENTION

Accordingly, an essential object of the present invention is to provide a floor nozzle for a vacuum cleaner in which change-over of a switch itself is adapted to be positively made by effecting the change-over of the switch through quick action, with generation of electrical arcs at contact portions being suppressed as far as possible.

Another object of the present invention is to provide a floor nozzle of the above described type in which the quick action at a high accuracy may be achieved by a simple construction through employment of a spring mechanism as a quick acting means having functionally stabilized portions at two positions, with a dead point being provided therebetween.

A further object of the present invention is to provide a floor nozzle of the above described type in which manufacture and assembly thereof are simplified to a large extent by forming an associating mechanism substantially with a single plate spring.

A still further object of the present invention is to provide a floor nozzle of the above described type in which, in the spring mechanism employing the plate spring, change-over of a switch is positively made by rationally effecting association thereof with the switch.

Another object of the present invention is to provide a floor nozzle of the above described type in which by arranging a junction between the extension pipe and the floor nozzle to be of a so-called pendulum structure, jolting feeling at the junction is eliminated so as not to give unstable impression.

In accomplishing these and other objects, according to one preferred embodiment of the present invention, there is provided a floor nozzle for a vacuum cleaner, which includes a housing , and an agitator, a driving motor for the agitator, and a switch for changing over rotating directions of said motor which are accommodated in said housing, a coupling pipe connected to said housing so as to be displaceable at least back and forth, and communicated with a suction passage to a vacuum cleaner main body, and an associating means for transmitting the back and forth displacement of said coupling pipe to said switch. The associating means is adapted to be held at two stabilized positions with respect to a boundary dead point and provided with a movable member arranged to be displaced through quick action, to one of the stabilized positions after passing through said dead point, with the movable member being associated with the switch.

By the above arrangement according to the present invention, an improved floor nozzle for a vacuum cleaner has been presented, with substantial elimination of disadvantages inherent in the conventional floor nozzles of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
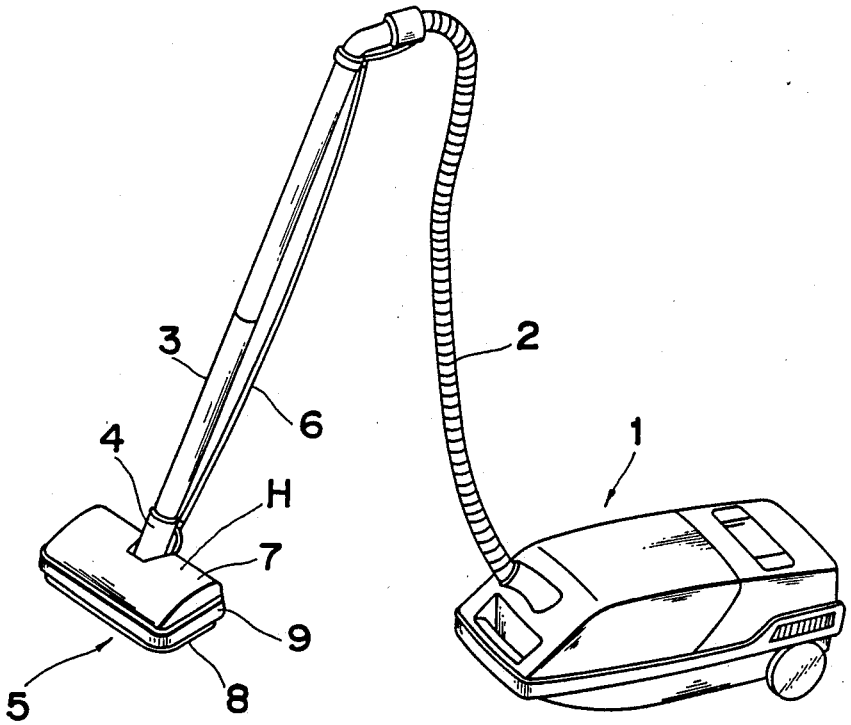
FIG. 1 is a perspective view of an electric vacuum cleaner to which a floor nozzle according to the present invention may be applied.

Before the description of the present invention proceeds, it is to be noted that like parts are designated by like reference numerals throughout the accompanying drawings.

Referring now to the drawings, there is shown in FIG. 1, an electric vacuum cleaner to which a floor nozzle 5 directly related to the present invention may be applied.

In FIG. 1, the vacuum cleaner generally includes a cleaner main body 1 in which a fan motor for air suction and a filter unit for filtering and collecting dust in the suction air, etc. (not particularly shown) are incorporated, an extension pipe 3 connected to a suction side of the main body 1 through a hose 2, and the floor nozzle 5 connected to the forward end of the extension pipe 3 through a coupling pipe 4. Energization of the floor nozzle 5 is arranged to be effected from the side of the cleaner main body 1 through a spiral reinforcing wire provided in the hose 2 and a cord 6 disposed along the outer side wall of the extension pipe 3.

Figure 2:
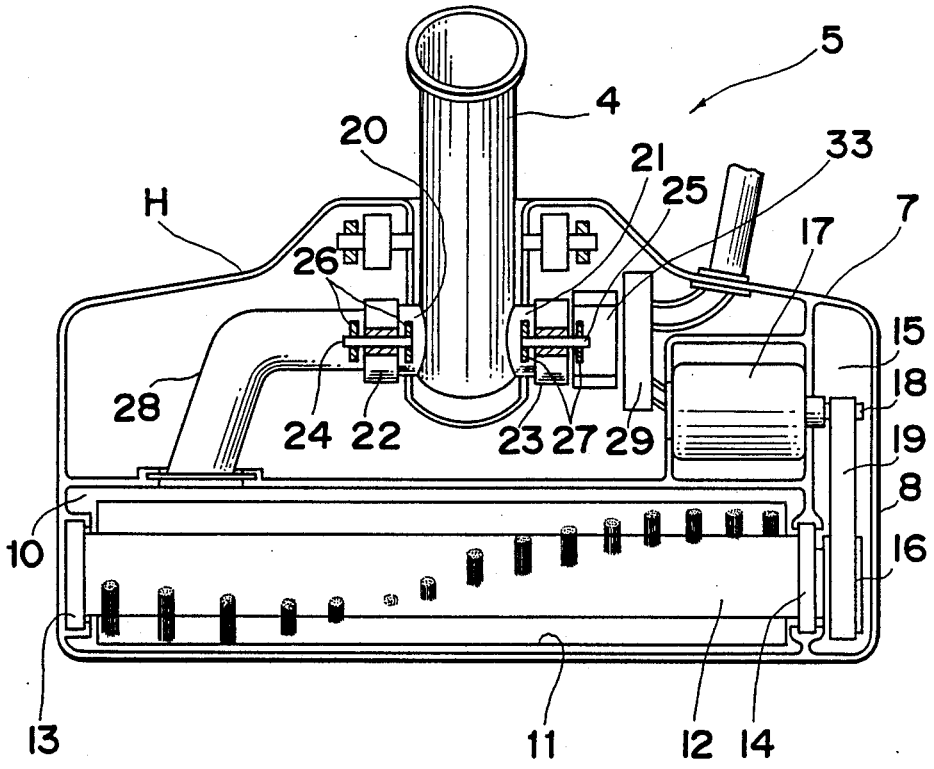
FIG. 2 is a horizontal cross section showing on an enlarged scale, the floor nozzle according to one preferred embodiment of the present invention.

Referring also to FIG. 2, the floor nozzle 5 includes a housing H constituted by upper and lower casings 7 and 8 combined with each other, and a bumper 9 made of an elastic material such as rubber or the like and covering the combined portion therebetween.

More specifically, the floor nozzle 5 has a suction chamber 10 laterally formed at its forward inner portion, and open into the lower casing 8 to provide a suction port 11. In the suction chamber 10, there is provided an agitator 12 rotatably supported by bearing portions 13 and 14 formed in the housing H and having a large diameter pulley 16 at its one end facing a belt chamber pulley 16 at its one end facing a belt chamber 15 formed at one side of the floor nozzle 5. In a position at the back of the suction chamber 10 and deviated towards the side of the belt chamber 15, a DC motor 17 is provided, with a belt 19 for power transmission being directed around a shaft 18 of said motor 17 extending into the belt chamber 15 and the large diameter pulley 16 of the agitator 12. In other words, it is so arranged that by the difference in the diameters of the shaft 18 and the pulley 16, the rotation of the motor 17 is transmitted to the agitator 12 through reduction in speed.

Meanwhile, the coupling pipe 4 provided at the forward end portion of the extension pipe 3 is closed at its forward end, and formed with support pipes 20 and 21 laterally projecting therefrom so as to have a generally T shape on the whole. The support pipe 20 at one side is open at its end face, while the support pipe 21 at the other side is closed at its end face. These support pipes 20 and 21 are rotatably fitted in ring members 22 and 23, which are respectively, rotatably suspended from the upper casing member 7 of the floor nozzle 5 through pins 24 and 25 so as to effect a pendulum motion. Ribs 26 and 27 are formed on the upper and lower casings 7 and 8 to support said pins 24 and 25.

Accordingly, the coupling pipe 4 supported by the ring members 22 and 23 is pivotable upwardly and downwardly, and also pivotable forwardly and backwardly about the pins 24 and 25.

To the support pipe 20 open at its end face, a communicating hose 28 made of a resilient material such as rubber or the like and derived from the suction chamber 10 is connected. Therefore, air containing the dust and drawn into the suction chamber 10 through the suction port 11 subsequently flows in the order of the communicating hose 28, support pipe 20, coupling pipe 4, extension pipe 3 and hose 2 so as to reach the filter device (not shown) in the cleaner main body 1.

Figure 3:
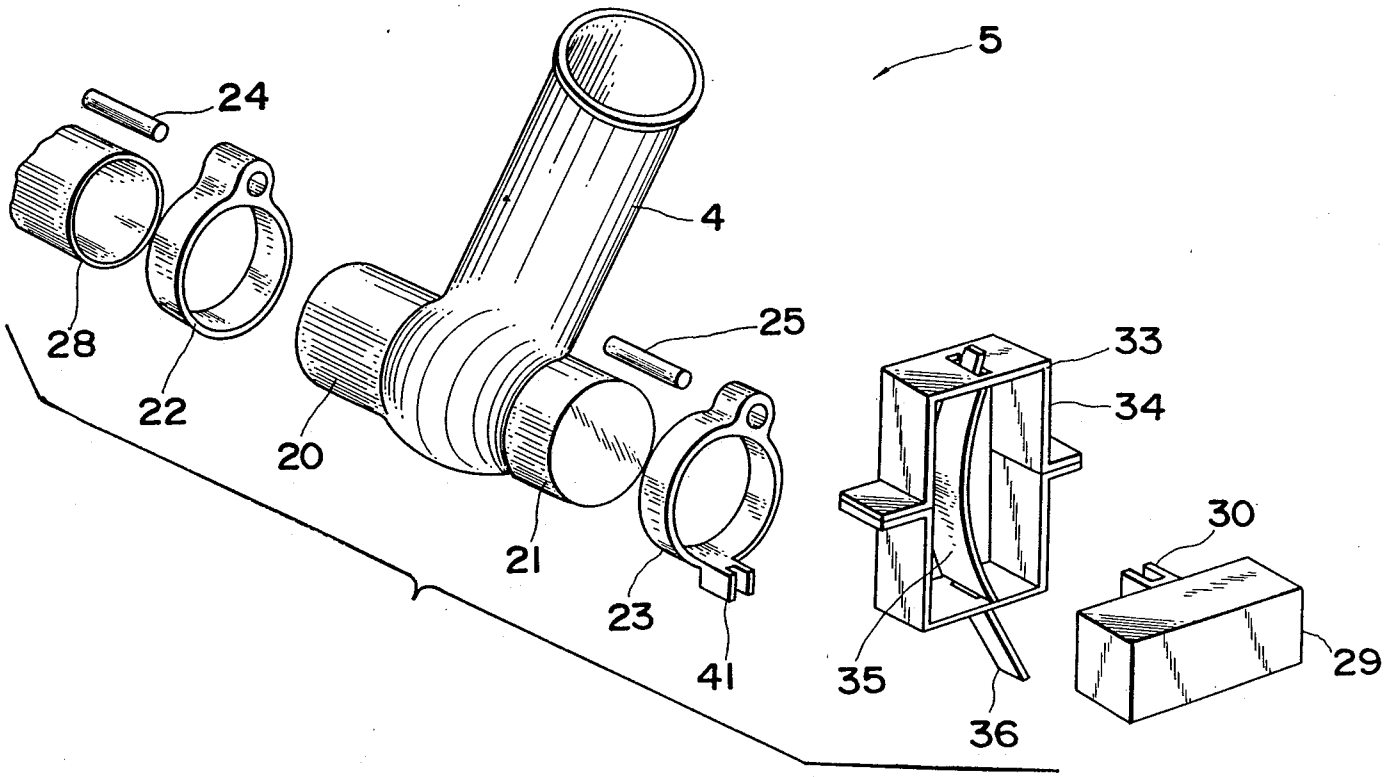
FIG. 3 is an exploded perspective view of a motor rotating direction change-over mechanism employed in the floor nozzle of FIG. 2.
Figure 6:
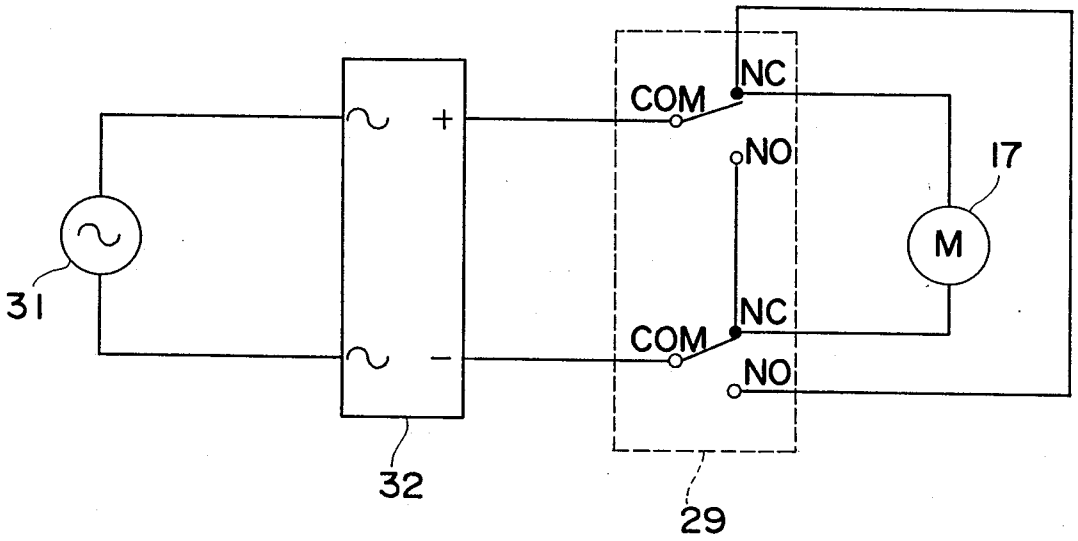
FIG. 6 is an electrical circuit diagram for the floor nozzle of FIG. 2.

Adjacent to the motor 17, there is provided a switch 29 for changing over the direction of rotation of said motor 17, with an actuator 30 of the switch 29 projecting outwardly from one side of a casing for said switch 29 (FIG. 3). FIG. 6 shows a general electrical circuit construction for the floor nozzle 5. In FIG. 6, an AC power from a power source 31 is applied to rectifying means 32 connected thereto, and the AC waveform is rectified into a full waveform. The switch 29 referred to above is connected to an output side of each rectifying means 32 so as to change-over the rotating direction of the motor 17 between the forward and reverse directions based on the directions of the current flowing through said motor 17 by selectively changing-over COM contacts to NC contact sides and NO contact sides.

Figure 5:
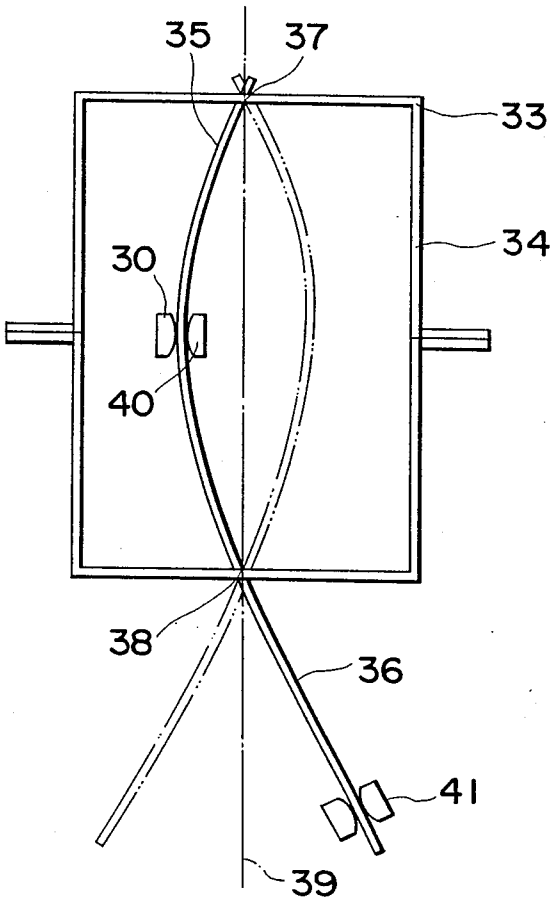
FIG. 5 is a schematic side sectional view for explaining functions of an associating means employed in the floor nozzle of FIG. 2.

Referring back to FIGS. 2 to 5, the floor nozzle 5 further includes an associating means 33 for transmitting the pivotal movement of the one ring member 23 to the actuator 30 of the switch 29 in a quickly acting manner. The associating means 33 referred to above is disposed between the ring member 23 and the switch 29, and constituted by a support frame 34 of a rectangular box-like configuration and a plate spring 35. This plate spring 35 is attached to the support frame 34 in a curved state, with an acting piece 36 being formed to extend from the lower end of said plate spring 35 towards the lower portion of said support frame 34. As shown in FIG. 5, the plate spring 35 has two opposed stabilized positions indicated by solid lines and two-dotted chain lines, with a displacing region being defined therebetween. In the case where the plate spring 35 is to be displaced, for example, form the solid line position towards the right side, after passing through a line 39 connecting attaching points 37 and 38 on the support frame 34, said plate spring 35 is displaced through quick action by its resiliency up to the position indicated by the two-dotted chain lines. Similarly, for the displacement in the opposite direction also, the plate spring 35 itself is quickly displaced towards the opposite side with respect to the point passing through the line 39, i.e. the dead point as a boundary point. During the above displacement, the central portion of the plate spring 35 between the attaching points 37 and 38, i.e. intermediate point 40 of the curvature is shifted only in a horizontal direction, without any vertical displacement. The actuator 30 of the switch 29 referred to earlier is associated with the intermediate point 40 of the curvature of the plate spring 35.

Figure 4:
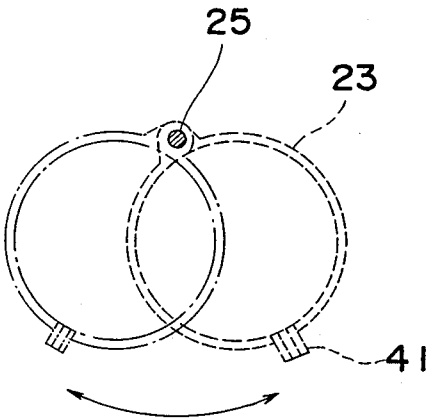
FIG. 4 is a diagram for explaining functions of a ring member for pivotally supporting a coupling pipe for the floor nozzle of FIG. 2.

Meanwhile, as shown in FIGS. 4 and 5, a claw 41 is formed to protrude from the support ring 23 for association with the acting piece 3 of the plate spring 35.

By the above arrangement, when the floor nozzle 5 is to be advanced, a depressing force is applied to the coupling pipe 4 through the extension pipe 3, whereby the support rings 22 and 23 are pivoted forwardly through the pins 24 and 25. As in FIG. 4 showing the state of the pivotal movement of the support ring 23, said ring 23 is displaced from the dotted line position to the one-dotted chain line position. In response to the above pivotal movement of the support ring 23, the claw 41 thereof displaces the acting piece 36 of the plate spring 35 forwardly, and upon passing through the dead point, said plate spring 35 quickly moves up to the one-dotted chain line position in FIG. 5. Following the inversion of the plate spring 35, the switch 29 is changed over, and its COM contacts are connected to the NC contacts.

In the above case, the direction of rotation of the motor 17 is so set that the rotation of the agitator 12 becomes in the forward direction with respect to the advancing of the floor nozzle 5.

Subsequently, when the floor nozzles 5 is to be retreated, a tensile strength is applied to the coupling pipe 4 to cause the ring 23 to pivot up to the rear position represented by the dotted lines in FIG. 4. Since the plate spring 35 is also displaced to the solid line position in FIG. 5 following the above function, the COM contacts of the switch 29 are changed over to the side of the NO contacts, whereby the current in the opposite direction is applied to the motor 17. Accordingly, the rotating direction of the motor 17 is set in the direction opposite to that up to that time, and thus, the rotating direction of the agitator 12 becomes also in the forward direction with respect to the retreatment of the floor nozzle 5.

As a result, in the above case, the rotational force of the agitator 12 is to be added to the operating force during movement of the floor nozzle 5 for reduction of labor.

On the contrary to the above case, when the rotational direction of the motor 17 is set so that the rotational force of the agitator 12 acts against the movement of the floor nozzle 5, the raking up force of the agitator 12, for example, with respect to a carpet becomes powerful, and thus, the dust sucking characteristic of the floor nozzle may be improved by that extent.

Moreover, if an initial rotating direction setting switch (not particularly shown) for arbitrarily setting the initial rotating direction of the motor 17 is separately provided, it is also possible to set the rotating direction of the agitator 12 to be in the forward or opposite direction with respect to the movement of the floor nozzle 5 in the course of the cleaning work.

The above function is significant for effecting cleaning suitable for actual conditions, for example, such that during cleaning work in which the agitator 12 is being rotated in the forward direction with respect to the moving direction of the floor nozzle 5 in order to reduce the operating force, if a portion heavily soiled is found at part of the carpet, the agitator 12 may be temporarily rotated in the opposite direction for positively removing such soiling.

As is clear from the foregoing description, according to the floor nozzle of the present invention, since the actuator 30 of the switch 29 is associated with the intermediate point 40 of curvature of the plate spring 35 without any vertical displacement, such associated portion is free from generation of twisting force, whereby the change-over function of the switch 29 and inversion displacement of the plate spring 35 may be effected smoothly. Moreover, since the inversion of the plate spring 35 is effected through quick action, arc generation at the contact portions of the switch 29 may be suppressed.

Furthermore, owing to the arrangement that the plate spring 35 is held at either one of the two stabilized positions, there is no possibility that the switch 29 remains in OFF state, and thus, malfunctions of the motor and consequently, of the agitator can be prevented.

Even when the inversion of the plate spring 35 should be undesirably locked by some causes, since the acting piece 36 is arranged to be merely subjected to the elastic displacement, damages, for example, to the actuator 30 of the switch 29 cam be advantageously prevented.

It should also be noted that, in the foregoing embodiment, although the plate spring is employed for the quick acting inversion mechanism, such plate spring may be replaced, for example, by a combination of a coil spring and a lever.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A floor nozzle for a vacuum cleaner which comprises a housing, and an agitator, a driving motor for the agitator, and a switch for changing over rotating directions of said motor which are accommodated in said housing, a coupling pipe connected to said housing so as to be displaceable at least back and forth, and communicated with a suction passage to a vacuum cleaner main body, and an associating means for transmitting the back and forth displacement of said coupling pipe to said switch, said associating means being adapted to be held at two stabilized positions with respect to a boundary dead point and provided with a movable member arranged to be displaced, through quick action, to one of the stabilized positions after passing through said dead point, said movable member being associated with said switch.

2. A floor nozzle as claimed in claim 1, wherein rotating direction of said agitator is set so as to be in a forward direction with respect to advancing or retreating function of the floor nozzle.

3. A floor nozzle as claimed in claim 1, wherein rotating direction of said agitator is set so as to be in an opposite direction with respect to advancing or retreating function of the floor nozzle.

4. A floor nozzle as claimed in claim 1, wherein said movable member for said associating means is constituted by a plate spring which is held by a holding means at intervals, with a portion of the plate spring between holding points thereof being resiliently curved.

5. A floor nozzle as claimed in claim 4, wherein an actuator for said switch is associated with an intermediate point of curvature of said movable member constituted by a plate spring.

6. A floor nozzle as claimed in claim 4, wherein one end of said plate spring is further extended from the holding point to form an acting piece, with which a back and forth displacing member of said coupling pipe is associated.

7. A floor nozzle as claimed in claim 1, wherein an actuator for said switch is associated with an intermediate point of curvature of said movable member constituted by a plate spring.

8. A floor nozzle as claimed in claim 1, wherein one end of said movable member constituted by a plate spring is further extended from the holding point to form an acting piece, with which a back and forth displacing member of said coupling pipe is associated.

9. A floor nozzle as claimed in claim 1, wherein one end of said coupling pipe is pivotally connected to the housing of the floor nozzle for back and forth rocking motion.

10. A floor nozzle as claimed in claim 9, wherein ring members pivotally supported at upper portions thereof for back and forth rocking motion are provided in said housing of the floor nozzle, with support pipes laterally projecting outwardly from a forward end of said coupling pipe being rotatably supported by said ring members.

11. A floor nozzle as claimed in claim 1, wherein ring members pivotally supported at upper portions thereof for back and forth rocking motion are provided in said housing of the floor nozzle, with support pipes laterally projecting outwardly from a forward end of said coupling pipe being rotatably supported by said ring members.

* * * * *